US005550920A

United States Patent [19]

Nomura

[11] Patent Number: 5,550,920

[45] Date of Patent: Aug. 27, 1996

[54] VOICE CANCELER WITH SIMULATED STEREO OUTPUT

[75] Inventor: Takashi Nomura, Nagaokakyo, Japan

[73] Assignee: Mitsubishi Denki Kabushiki Kaisha, Kyoto, Japan

[21] Appl. No.: 293,462

[22] Filed: Aug. 19, 1994

[30] Foreign Application Priority Data

Aug. 30, 1993 [JP] Japan ..... 5-214125

[51] Int. Cl.[6] ..... H04S 5/00

[52] U.S. Cl. ..... 381/1; 381/17

[58] Field of Search ..... 381/17, 1

[56] References Cited

U.S. PATENT DOCUMENTS

| | | | |
|---|---|---|---|
| 4,694,497 | 9/1987 | Kasai et al. | 381/17 |
| 4,833,715 | 5/1989 | Sakai | 381/17 |
| 5,197,100 | 3/1993 | Shiraki | 381/27 |

FOREIGN PATENT DOCUMENTS

| | | |
|---|---|---|
| 63-105600 | 5/1988 | Japan . |
| 64-52366 | 3/1989 | Japan . |
| 5-48500 | 6/1993 | Japan . |

OTHER PUBLICATIONS

Schroeder, "An Artificial Stereophonic Effect Obtained from a Single Audio Signal," JAES, Apr. 1958, vol. 6, No. 2. pp. 74–79.

Lancaster, Active Filter Cookbook, 1979, pp. 205–208.

*Primary Examiner*—Forester W. Isen

[57] ABSTRACT

A vocal canceler receives left- and right-channel input signals, and combines their non-vocal components into a single monaural karaoke signal. It then shifts the monaural karaoke signal by one phase angle to produce a left-channel output signal, and by another phase angle to produce a right-channel output signal, providing a simulated stereo effect.

13 Claims, 5 Drawing Sheets

VOICE CANCELER WITH SIMULATED STEREO OUTPUT

BACKGROUND OF THE INVENTION

This invention relates to a vocal canceler for providing karaoke output from an audio or video device such as a radio or television set or video cassette recorder.

Karaoke refers to output of the musical accompaniment to a song without the singer's voice, so that the user can substitute his or her own voice. This form of entertainment has become extremely popular in Japan, where the term originated, and elsewhere. Both audio and video karaoke recordings are available. A recent idea is to equip a television set or video cassette recorder with a vocal canceler, permitting the user to create karaoke material by suppressing the singer's voice in vocal music broadcasts.

A conventional vocal canceler operates on broadcasts with stereo sound, by taking the sum and difference of the left- and right-channel sound signals. The sum signal is filtered to eliminate voice frequencies, then combined with the difference signal and supplied to both the right and left output channels. A problem with this conventional circuit is that since the left and right channels receive identical output signals, the output is monophonic, lacks spatial spread, and fails to provide the feeling of presence afforded by the original stereo signal.

SUMMARY OF THE INVENTION

It is accordingly an object of the present invention to provide a vocal canceler with simulated stereo output.

A second object of the invention is to avoid unwanted voice canceling of non-stereo signals.

The invented vocal canceler combines the non-vocal components of the left- and right-channel input signals into a single monaural karaoke signal. It then shifts the monaural karaoke signal by one phase angle to produce a left-channel output signal, and by another phase angle to produce a right-channel output signal, thereby providing a simulated stereo effect.

DETAILED DESCRIPTION OF THE INVENTION

Embodiments of the invention will be described with reference to the attached drawings. These drawings illustrate the invention but do not restrict its scope, which should be determined solely from the appended claims.

Figure 1:
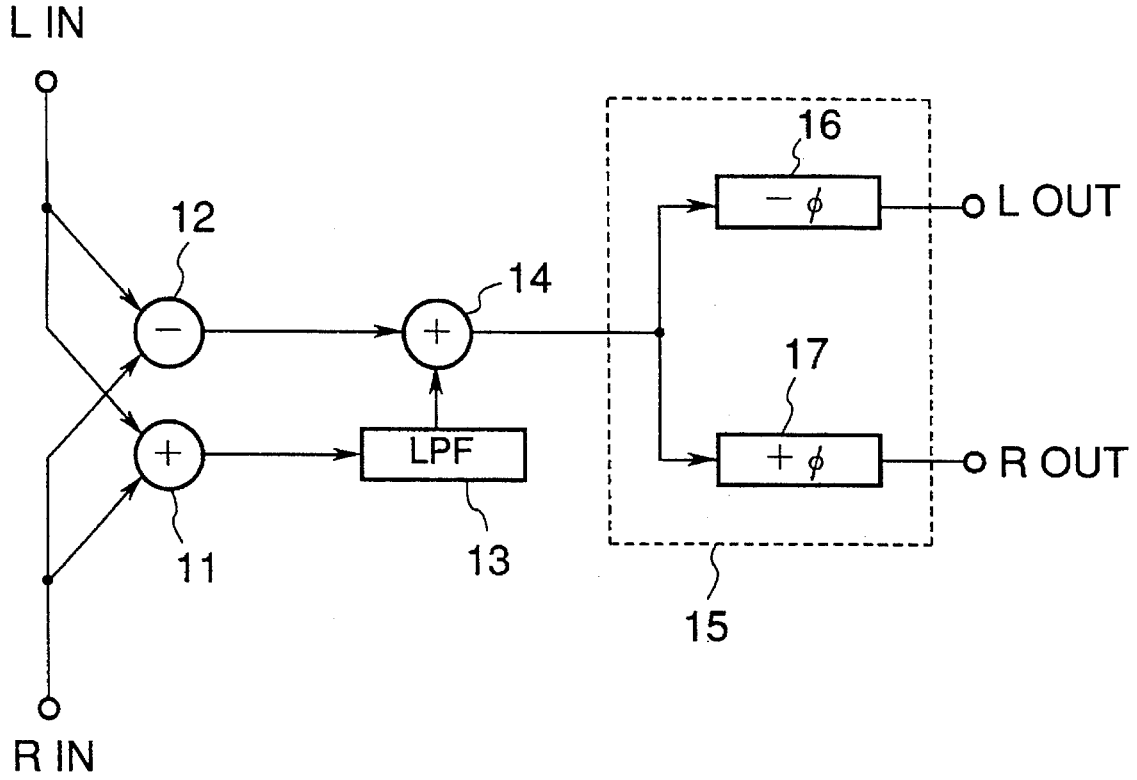
FIG. 1 is a schematic diagram of a first embodiment of the invented vocal canceler.

Referring to FIG. 1, all embodiments receive a left-channel input signal (LIN) and a right-channel input signal (RIN), and generate a left-channel output signal (LOUT) and a right-channel output signal (ROUT). All embodiments comprise a first summing circuit 11 for adding the left-channel input signal LIN and right-channel input signal RIN, a differencing circuit 12 for taking the difference between the left-channel input signal LIN and right-channel input signal RIN, a low-pass filler (LPF) 13 coupled to filter the sum signal output by the first summing circuit 11, thereby producing a low-frequency signal, a second summing circuit 14 for adding this low-frequency signal to the difference signal produced by the differencing circuit 12, and a phase-shifting circuit 15 that receives the signal output by the second summing circuit 14.

In the first embodiment, as shown in FIG. 1, the phase-shifting circuit 15 comprises a first phase shifter 16 that shifts the output of the second summing circuit 14 by a first phase angle $-\phi$, and a second phase shifter 17 that shifts the output of the second summing circuit 14 by a second phase angle $+\phi$. The two phase angles $-\phi$ and $+\phi$ are equal in magnitude and opposite in sign. The output of the first phase shifter 16 is the left-channel output signal LOUT. The output of the second phase shifter 17 is the right-channel output signal ROUT.

The summing, differencing, and phase-shifting circuits in FIG. 1 can be constructed by using, for example, well-known operational amplifier circuits. Specific circuit descriptions will be omitted to avoid obscuring the invention with needless detail.

Next the operation will be explained.

In a vocal musical broadcast, the singer's voice is normally picked up by a single microphone located directly in front of the singer, often a hand-held microphone, while the musical accompaniment is picked up by, for example, two microphones disposed on either side of the singer. The singer's voice signal is accordingly identical in the left- and right-channel input signals LIN and RIN, while the musical accompaniment signals differ between the two channels.

In the difference signal output by the differencing circuit 12, the singer's voice signal is therefore completely canceled. The musical accompaniment is attenuated to various degrees, depending on the placement of different instruments in relation to the microphones and the specific frequencies involved.

The output of the summing circuit 11 comprises all frequencies of both channels. The cut-off frequency of the low-pass filter 13 is set at or below the bottom of the human vocal range, so that voice frequencies are removed From the output of the low-pass filter 13, which consists of a mixture of the lower frequencies of the musical accompaniment from both channels. The output of the low-pass filter 13 compensates for the attenuation of these lower frequencies in the output of the differencing circuit 12.

The output of the second summing circuit 14 is accordingly a monaural karaoke signal consisting of the musical accompaniment with some attenuation of higher instrumental frequencies, and with the singer's voice completely removed. The first phase shifter 16 shifts this monaural karaoke signal by a phase angle of $-\phi$ degrees to produce the left-channel output signal LOUT, while the second phase shifter 17 shifts the monaural karaoke signal by a phase angle of $+\phi$ degrees to produce the right-channel output signal ROUT. These phase shifts make different frequencies seem to come from different locations, thereby restoring spatial spread, creating a stereo illusion, and giving a sense of presence in the audio output.

Figure 2:
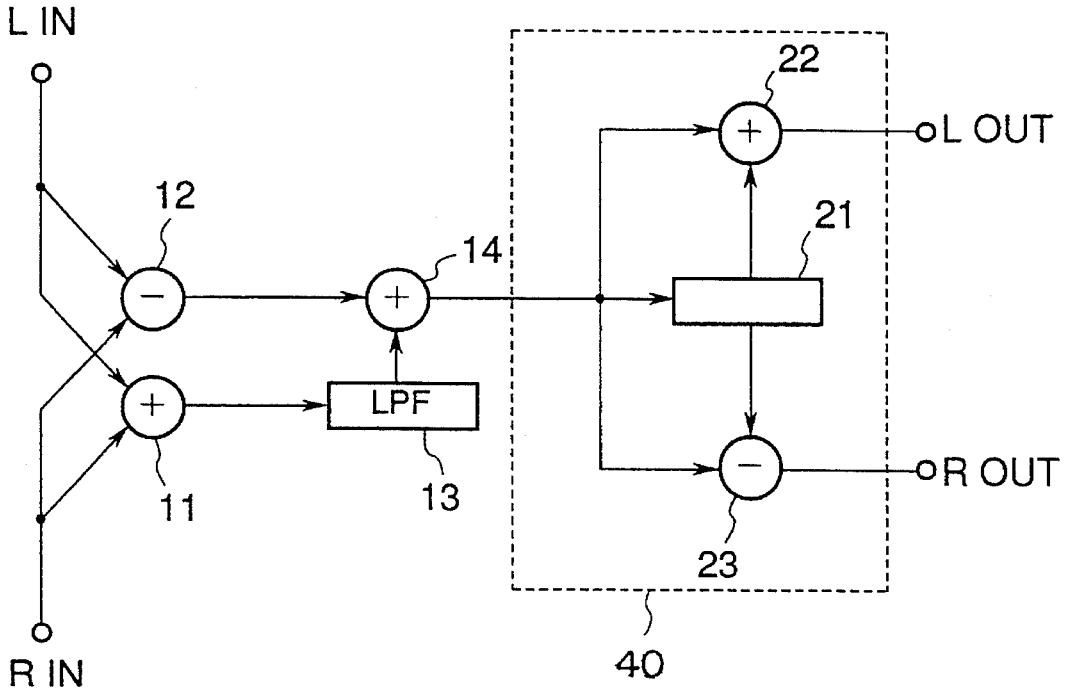
FIG. 2 is a schematic: diagram of a second embodiment of the invented vocal canceler.

FIG. 2 shows a second embodiment, comprising the same summing circuits 11 and 14, differencing circuit 12, and low-pass filter 13 as the first embodiment, but differing in the structure of the phase-shifting circuit 15. The phase-shifting circuit 15 in FIG. 2 comprises a phase shifter 21 for phase-shifting the monaural karaoke signal output by the second summing circuit 14 to produce a phase-shifted signal, and a further pair of summing and differencing circuits 22 and 23. The third summing circuit: 22 adds the phase-shifted signal output by the phase shifter 21 to the monaural karaoke signal thereby producing the left-channel output signal LOUT. The second differencing circuit 23 subtracts the phase-shifted signal output by the phase shifter 21 from the monaural karaoke signal, thereby producing the right-channel output signal ROUT.

The left- and right-channel output signals LOUT and ROUT have phase shifts that depend on the output amplitude and phase shift $\phi$ of the phase shifter 21. For example, if $\phi=\pi/2$ (ninety degrees) and the input and output amplitudes of the phase shifter 21 are equal, the phase-shifting circuit 15 in FIG. 2 functions like the phase-shifting circuit 15 in FIG. 1, shifting the phase of the monaural karaoke signal by $\pi/4$ (forty-five degrees) in opposite directions in the left and right channels. The phase angle $\phi$ and the amplification factors of the phase shifter 21, third summing circuit 22, and second differencing circuit 23 can be adjusted to provide other combinations of phase shifts in the left and right output channels, as desired.

The first and second embodiments provide satisfactory output signals from stereo input, but the sound signals of many television broadcasts are monaural, the left- and right-channel input signals being identical, and some broadcasts are bilingual, the left and right channels being used to carry sound tracks in different languages. For a monaural broadcast, the output of the differencing circuit 12 is completely mute, and the user hears only the low frequencies passed by the low-pass filter 13. For a bilingual broadcast, both channels pass through the differencing circuit 12 and the user hears both languages at once. In neither case is the output satisfactory.

Figure 3:
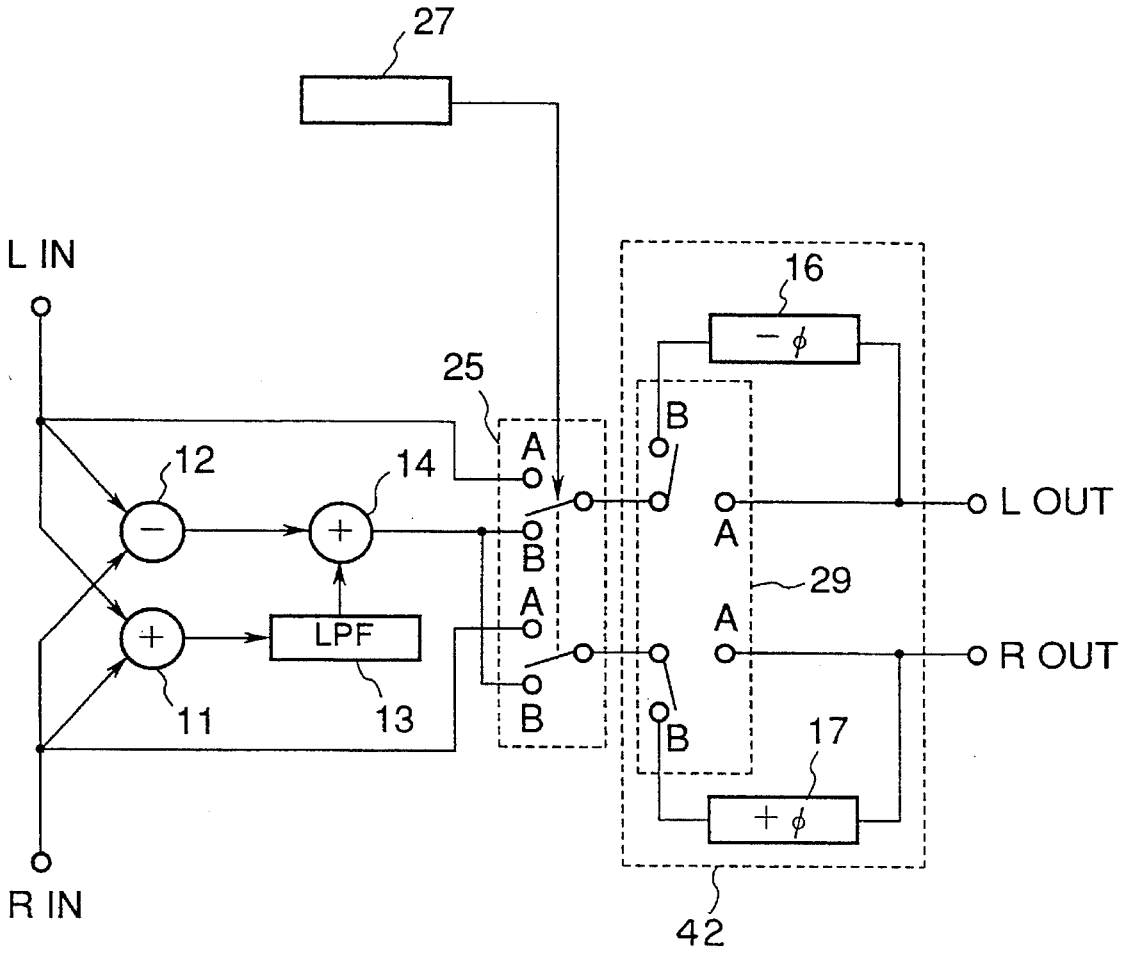
FIG. 3 is a schematic diagram of a third embodiment of the invented vocal canceler.

The third embodiment provides a solution to this problem by allowing the vocal canceler to operate only when the input is stereo. Referring to FIG. 3, the third embodiment comprises the summing circuits 11 and 14, differencing circuit 12, anti low-pass filter 13 of the first and second embodiments but now has a first switch 25 that furnishes separate left- and right-channel inputs to the phase-shifting circuit 15. This switch 25 is controlled by a stereo discriminator 27 that determines whether the left- and right-channel input signals constitute a stereo signal or not. The phase-shifting circuit 15 is similar to the phase-shifting circuit 15 in FIG. 1, but has a second switch 29 that selects whether or not to route the input signals through the phase shifters 16 and 17.

When the stereo discriminator 27 detects stereo input, it sets the first switch 25 to the position marked by the letter B. The second switch 29 is also set to the B position. The monaural karaoke signal output by the second summing circuit 14 is supplied as both the left- and right-channel inputs to the phase-shifting circuit 15, and is sent through the phase shifters 16 and 17, providing the same vocal-canceled, simulated stereo output as in the first embodiment.

When the stereo discriminator 27 detects that the input is not stereo, it sets the first switch to the position marked by the letter A, so that the unaltered left- and right-channel input signals LIN and RIN are sent to the phase-shifting circuit 15. This avoids unwanted voice canceling of monaural and bilingual input signals. If the second switch 29 is also set to the A position, these unaltered signals become the left- and right-channel output signals LOUT and ROUT.

The first and second switches 25 and 29 can be linked so that they always operate together as described above, either both being set, to the A position, or both to the B position. Alternatively, they can be controlled independently, providing the user with further options. One option is monaural output of a vocal-canceled stereo signal, as in a conventional vocal canceler, by setting the second switch 29 to the A position when the first switch 25 is set to the B position. Another option is simulated stereo output of a monaural input signal, by setting the second switch 29 to the B position when the First switch 25 is set to the A position.

Figure 4:
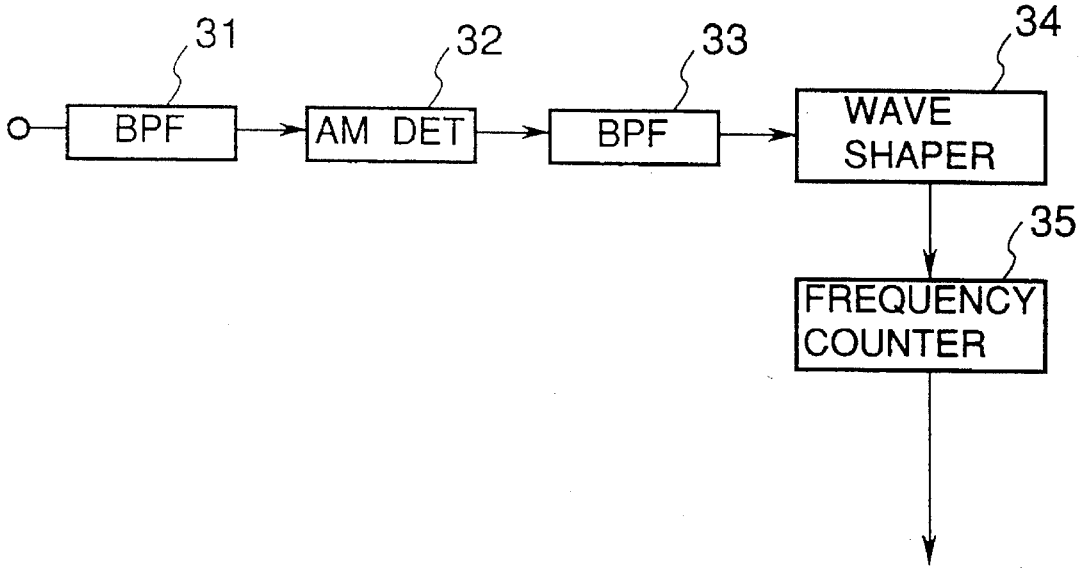
FIG. 4 is a schematic diagram of the stereo discriminator in FIG. 3.

FIG. 4 shows one possible configuration of the stereo discriminator 27, designed for a television system in which stereo and bilingual broadcasts are identified by cue signals superimposed on the sound signal. Stereo broadcasts have a cue frequency of 952 Hz: bilingual broadcasts have a cue Frequency of 922 Hz; monaual broadcasts have no cue signal.

This stereo discriminator comprises a first bandpass filter 31, an amplitude-modulation (AM) detector 32, a second bandpass filter 33, a wave shaper 34, and a frequency counter 35, coupled in series. The first bandpass filter 31 passes an intermediate frequency band containing the stereo cue signal. The AM detector 32 demodulates the resulting signal to a baseband sound signal. The second bandpass filter 33 passes the stereo cue frequency of 952 Hz. The wave shaper 34 reshapes the resulting output signal to remove distortion and restore lost amplitude. The frequency counter 25 counts the frequency of the reshaped signal for positive identification of the stereo cue. The output of the frequency counter 25 is furnished to a circuit such as a microcontroller, not shown in the drawing, which controls the first switch 25 in FIG. 3.

Figure 5:
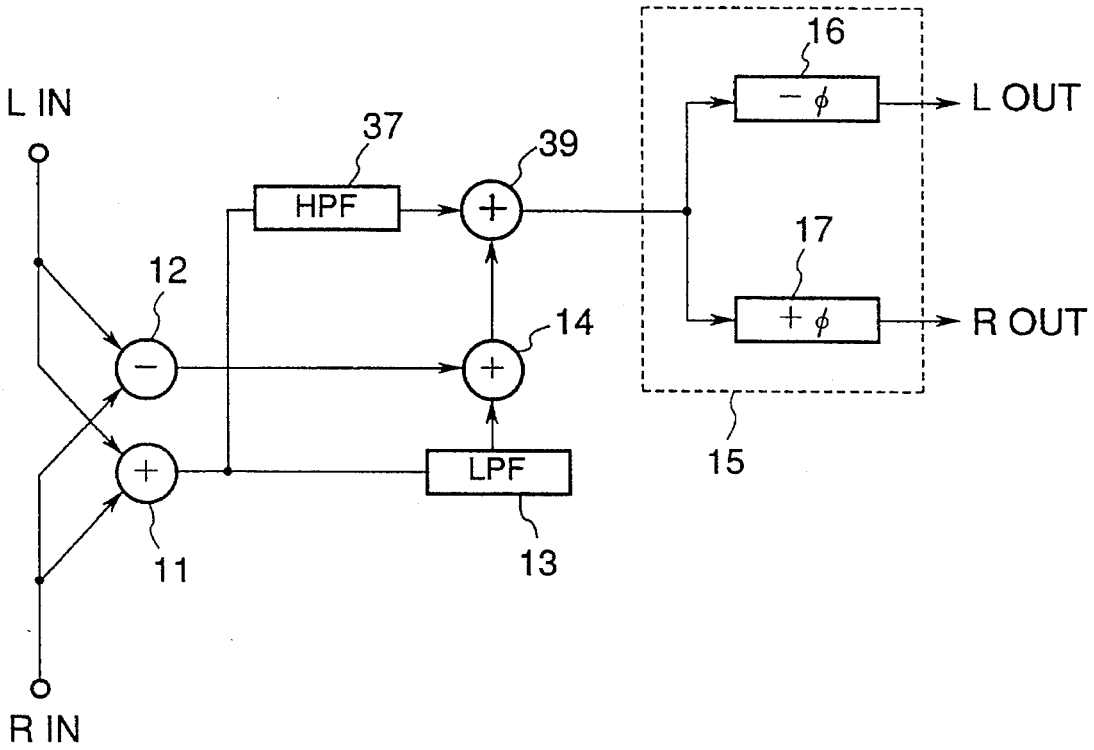
FIG. 5 is a schematic diagram of a fourth embodiment of the invented vocal canceler.

FIG. 5 shows a fourth embodiment, which is identical to the first embodiment in FIG. 1 except for the addition of a high-pass filter (HPF) 37 and a fourth summing circuit 39. The high-pass filter 37 receives the output of the first summing circuit 11. The fourth summing circuit 39 adds the output of the high-pass filter 37 to the monaural karaoke signal output by the second summing circuit 14. The phase-shifting circuit 15 receives the output of the fourth summing circuit 39 instead of the output of the second summing circuit 14.

The high-pass filter 37 has a cutoff frequency equal to or higher than the top of the human vocal range. Together, the low-pass filter 13 and high-pass filter 37 form a band-stop filter that eliminates vocal frequencies from the output of the first summing circuit 11 while passing higher and lower frequencies.

If the LIN and RIN inputs are stereo, the fourth embodiment provides essentially the same simulated stereo karaoke output as the first embodiment, but with greater timbre, as the high-pass filter 37 allows more overtones and other high instrumental frequencies to pass.

If the LIN and RIN inputs are monaural, the fourth embodiment cancels voice frequencies while allowing both higher and lower frequencies to pass. Although the midrange of the musical accompaniment is removed, the remaining instrumental frequencies are still usable for karaoke purposes, and the phase-shifting circuit 15 produces a simulated stereo effect.

Although the third and fourth embodiments in FIGS. 3 and 5 employed the phase-shifting circuit 15 of the first embodiment in FIG. 1, they could just as well use the phase-shifting circuit of the second embodiment in FIG. 2. Other phase-shifting circuit configurations are also possible:

for example, analog delay lines can be used instead of phase shifters. The resulting phase shifts will be frequency-dependent, and will provide a type of echo effect that also simulates a stereo output signal. If the left and right channel signals are digital, memory circuits such as first-in-first-out (FIFO) circuits can be used instead of phase shiffters in a similar way.

Those skilled in the art will recognize that still further modifications can be made without departing from the scope claimed below.

What is claimed is:

1. A vocal canceler for producing simulated stereo karaoke output from a left-channel input signal and a right-channel input signal, comprising:

a differencing circuit for taking a difference between said left-channel input signal and said right-channel input signal to produce a difference signal;

a first summing circuit for adding said left-channel input signal and said right-channel input signal to produce a sum signal;

a low-pass filter coupled to filter said sum signal to produce a low-frequency signal;

a second summing circuit for adding said difference signal and said low-frequency signal to produce a monaural karaoke signal;

a phase-shifting circuit for shifting said monaural karaoke signal by a first phase angle to produce a left-channel output signal and by a second phase angle to produce a right-channel output signal;

a stereo discriminator for determining whether said left-channel input signal and said right-channel input signal constitute a stereo signal; and a first switch, controlled by said stereo discriminator, for selecting said monaural karaoke signal for input to said phase-shifting circuit when said left-channel input signal and said right-channel input signal constitute a stereo signal, and selecting said left-channel input signal and said right-channel input signal for input to said phase-shifting circuit, in place of said monaural karaoke signal, when said left-channel input signal and said right-channel input signal do not constitute a stereo signal.

2. The vocal canceler of claim 1, wherein said phase-shifting circuit comprises:

a first phase shifter for phase-shifting said monaural karaoke signal by said first phase angle; and a second phase shifter for phase-shifting said monaural karaoke signal by said second phase angle.

3. The vocal canceler of claim 2, wherein said first phase angle and said second phase angle have equal magnitudes and opposite signs.

4. The vocal canceler of claim 1, wherein said phase-shifting circuit comprises:

a phase shifter for phase-shifting said monaural karaoke signal to produce a phase-shifted signal;

a third summing circuit for adding said phase-shifted signal to said monaural karaoke signal; and a second differencing circuit for subtracting said phase-shifted signal from said monaural karaoke signal.

5. The vocal canceler of claim 1, wherein said phase-shifting circuit has a second switch that enables phase shifting by said phase-shifting circuit when set to one state, and disables said phase shifting when set to another state.

6. A vocal canceler or producing simulated stereo karaoke output from a left-channel input signal and a right-channel input signal, comprising:

a differencing circuit for taking a difference between said left-channel input signal and said right-channel input signal to produce a difference signal;

a first summing circuit for adding said left-channel input signal and said right-channel input signal to produce a sum signal;

a low-pass filter coupled to filter said sum signal to produce a low-frequency signal;

a second summing circuit for adding said difference signal and said low-frequency signal to produce a monaural karaoke signal;

a phase-shifting circuit for shifting said monaural karaoke signal by a first phase angle to produce a left-channel output signal and by a second phase angle to produce a right-channel output signal;

a high-pass filter, independent of said low-pass filter, coupled to filter said first sum signal to produce a high-frequency signal; and a third summing circuit coupled to add said high-frequency signal to said monaural karaoke signal before input of said monaural karaoke signal to said phase-shifting circuit.

7. A method of producing simulated stereo karaoke output from a left-channel input signal and a right-channel input signal, comprising the steps of:

combining non-vocal components of said left-channel input signal and said right-channel input signal into a single monaural karaoke signal;

determining whether said left-channel input signal and said right-channel input signal constitute a stereo signal;

first selecting said monaural karaoke signal for input to a phase-shifting circuit when said left-channel input signal and said right-channel input signal constitute a stereo signal;

second selecting said left-channel input signal and said right-channel input signal for input to said phase-shifting circuit, in place of said monaural karaoke signal, when said left-channel input signal and said right-channel input signal do not constitute a stereo signal; and first shifting, with said phase-shifting circuit, said monaural karaoke signal by a first phase angle to produce a left-channel output signal, and by a second phase angle to produce a right-channel output signal when said first selecting step inputs said monaural karaoke signal to said phase-shifting circuit; and second shifting, with said phase-shifting circuit, said left-channel input signal by said first phase angle to produce said left-channel output signal, and shifting said right-channel input signal by said second phase angle to produce said right-channel output signal when said second selecting step inputs said left-channel input signal and said right-channel input signal to said phase-shifting circuit.

8. The method of claim 7, comprising further steps of:

enabling said step of shifting when said left-channel input signal and said right-channel input signal constitute a stereo signal; and disabling said step of shifting when said left-channel input signal and said right-channel input signal do not constitute a stero signal.

9. The method of claim 7, wherein said step of combining comprises further steps of:

taking a difference between said left-channel input signal and said right-channel input signal to produce a difference signal;

adding said left-channel input signal and said right-channel input signal to produce a sum signal;

filtering said sum signal to remove voice frequencies, thereby producing a filtered signal; and adding said difference signal and said filtered signal to produce said monaural karaoke signal.

10. The method of claim 9, wherein said step of filtering comprises low-pass filtering.

11. The method of claim 9, wherein said step of filtering comprises band-stop filtering.

12. The method of claim 7, wherein said first phase angle and said second phase angle have equal magnitudes and opposite signs.

13. The method of claim 7, wherein said step of shifting comprises:

phase-shifting said monaural karaoke signal to produce a phase-shifted signal;

adding said phase-shifted signal to said monaural karaoke signal to produce one of said left-channel output signal and said right-channel output signal; and subtracting said phase-shifted signal from said monaural karaoke signal to produce another of said left-channel output signal and said right-channel output signal.

* * * * *